US008668032B2

(12) United States Patent
Langhart

(10) Patent No.: US 8,668,032 B2
(45) Date of Patent: Mar. 11, 2014

(54) CORE DRILL BIT

(76) Inventor: Christopher Dale Langhart, New Hope, PA (US)

( * ) Notice: Subject to any disclaimer, the term of this patent is extended or adjusted under 35 U.S.C. 154(b) by 310 days.

(21) Appl. No.: 13/012,894

(22) Filed: Jan. 25, 2011

(65) Prior Publication Data

US 2012/0186876 A1 Jul. 26, 2012

(51) Int. Cl.
*E21B 10/02* (2006.01)

(52) U.S. Cl.
USPC ..... 175/403

(58) Field of Classification Search
USPC ..... 175/403, 405.1, 332, 333
See application file for complete search history.

(56) References Cited

U.S. PATENT DOCUMENTS 4,168,755 A * 9/1979 Willis ..... 175/343
7,204,244 B1 4/2007 Pedersen
2009/0283326 A1* 11/2009 Oothoudt ..... 175/58

* cited by examiner

*Primary Examiner* — Brad Harcourt
(74) *Attorney, Agent, or Firm* — IP Works, PLLC

(57) ABSTRACT

An abrasive drill bit includes: a hollow tubular body having a rotation axis and being configured to be rotated by a drill about the rotation axis; and a plurality of teeth disposed around the periphery of a distal end of the tubular body and extending distally from the tubular body, each of the plurality of teeth supporting a drilling abrasive, wherein the distal extension of the teeth relative to each other varies cyclically along the periphery of the distal end of the tubular portion such that when the drill bit is rotated about the rotation axis and advanced along the rotation axis into a surface of a drilled material, at least one distal-most tooth maintains contact with the surface and at least one least distally extending tooth does not contact the surface.

20 Claims, 8 Drawing Sheets

CORE DRILL BIT

FIELD OF THE INVENTION

The present invention relates generally to abrasive drill bits. More specifically, the present invention relates to abrasive drill bits that may be suitable for drilling hard brittle materials, such as concrete or stone.

BACKGROUND

For drilling holes, e.g., horizontal, vertical, and/or slanted holes, into a medium, e.g., concrete, stone, etc., a drilling frame motor support and drill require support, especially during the earlier stages of drilling, where the drill has not penetrated a substantial distance into the medium. During drilling of deeper holes, typical drills provide for relatively rapid progress at the beginning of the drilling operation and very slow progress toward the end. Drills of substantial length, e.g., one foot long drills, may become constricted by the walls of the hole as the drill progresses into the medium. Reduction in progress may be attributed to reduced oscillation of the motor end of the drill and/or reduced vibration of the drill support, which is increasingly constrained as the drill progresses further into the material and the hole gets deeper.

A known technique to address the limitations of this procedure is to drill a larger hole first and then use progressively smaller drills. For example, when drilling a horizontal hole into a concrete wall with a 4½ inch core drill bit spinning at 200 to 300 rpm with a pushing force of 100 to 150 pounds, the bit or the material cutting face may glaze over and experience a reduction in cutting speed (i.e., drilling depth per unit time) to less than ⅓ the cutting speed experienced during the initial stages of drilling. The speed may be increased by orbiting or oscillating the rotational axis of the bit, e.g., using a 2 to 5, e.g., 3 to 4 degree orbit. The orbiting or oscillation may involve moving the rear portion of the bit, e.g., in a circular motion, with respect to the axis of the hole being drilled, with the tip of the drill remaining substantially in a constant radial location, typically centered at the axis of the hole. In order to accommodate the motion of the drill bit, graduated bit sizes may be used during the progression of the drilling, such that larger diameter bits are used at the early stages and progressively smaller diameter bits are used as the drill axially progresses to form the hole. In this manner, adequate clearance may be provided to orbit or oscillate the bit. The technique of drilling a large hole first and then using progressively smaller drill bits as the hole gets deeper permits vibrational and/or rotational oscillation of the drill motor end and therefore allows for faster drilling progress as the drill works toward the end of the hole.

Although the conventional orbiting/oscillating technique may improve drilling performance, the use of multiple drills is tedious and the resulting hole may not be structurally and/or visually acceptable. For example, in renovation situations where large pipes such as electrical feeders or sprinkler mains must be passed through existing masonry partitions in full view, this technique may be visually unappealing and result in the removal of more material than necessary. Additionally, using multiple drills of different sizes increases time, labor, and cost.

Using a core drill with abrasive teeth diamond coated teeth) is common for holes variously above an inch and half in diameter in masonry materials like concrete and stone. Experience has shown that oscillating the drill motor while the teeth are (partially) contacting the face of the material makes the drilling process faster. For drilling deeper holes, common advice is to have a larger hole at the start of the process and as the hole progresses deeper, to use progressively smaller drills. This permits space at the beginning of the hole for orbital motion of the drill motor. As indicated above, moving the drill motor end of the drill in an orbital path makes the drilling process faster. The design of the improved bit described here produces faster drilling while allowing constant diameter holes without moving the drill motor.

There is a need for a drill bit that provides increased axial drilling speed without the need to orbit or oscillate the proximal portion of the drill bit. Moreover, there is a need for a drill bit that allows a relatively constant hole diameter along the length of the drilled hole and avoids unnecessary removal of material, such as caused by successively drilling holes of differing diameters according to the method described above. Still further, there is a need for a drill bit and drilling method that allows for more uniform and visually appealing results.

SUMMARY

According to an example embodiment of the present invention, an abrasive core drill bit includes: a hollow tubular body having a rotation axis and being configured to be rotated by a drill about the rotation axis; and a plurality of teeth disposed around the periphery of a distal end of the tubular body and extending distally from the tubular body, each of the plurality of teeth supporting a drilling abrasive, wherein the distal extension of the teeth relative to each other varies cyclically along the periphery of the distal end of the tubular portion such that when the drill bit is rotated about the rotation axis and advanced along the rotation axis into a surface of a drilled material, at least one distal-most tooth maintains contact with the surface and at least one least distally extending tooth does not contact the surface.

The drill bit may further include a shank coupled to the hollow tubular body and configured to be received by the drill in order to rotate the hollow tubular body about the rotation axis.

The teeth may be formed as monolithic extensions of the tubular portion prior to application of the drilling abrasive. The drill may be adapted to drill through concrete. At least one distal-most tooth may support a thicker deposit of abrasive than the at least one proximal-most tooth. The drill may be configured to drill a straight tubular hole. The tubular portion may be angled slightly about the rotation axis to produce tooth face contact emulating circular oscillation of the drill motor, yet allowing the drill motor to remain on the center line of rotation. The drill bit may be configured so that the teeth of the drill are varied in length (e.g., as illustrated as dimension 6 in the Figures); wherein each of the teeth has a face with a curved profile that forms a continuous profile with adjacent teeth as the continuous profile extends around the circumference of the tubular portion. Moreover, each tooth may have a distal face that is perpendicular to the rotation axis.

According to another example embodiment of the present invention, a method of drilling into a material includes: rotating an abrasive drill bit about a rotation axis; while rotating the drill bit, advancing the drill bit in a forward direction along the rotation axis. Throughout the advancing step, at least one distal-most tooth maintains constant contact with the surface of the material, and at least one proximal-most tooth remains at an axial distance from the surface of the material.

According to another example embodiment of the present invention, a tubular abrasive drill includes a tubular body supporting a drilling/cutting abrasive such that teeth are cyclically various distances from the material being abraded. One or more than one cycle of longer and shorter teeth may be tangent to the workface. The drill may have increasing deposits of abrasive material on teeth that maintain direct contact with the work face and/or contact the work face first, thereby compensating for abrasive loss due to the longer contact time of some teeth with the material than others. The drill may provide the tooth contact advantage of an oscillating drill motor while allowing the drilling of a straight tubular hole. In this regard, drilling arrangements in accordance with the present invention may forego oscillating drill motors. The tubular body of the drill may be angled slightly about the center line to produce tooth face contact emulating circular oscillation of the drill motor, yet allow the drill motor to remain on the center line of rotation.

An example abrasive core drill bit comprises: a shank having a rotation axis and configured to be received by a drill and to be rotated by the drill about the rotation axis; a hollow tubular portion extending distally from the shank and being rotationally fixed with respect to the shank; and a plurality of teeth disposed around the periphery of a distal end of the tubular portion and extending distally from the tubular portion, each of the plurality of teeth supporting a drilling abrasive, wherein the distal extension of the teeth relative to each other varies cyclically along the periphery of the distal end of the tubular portion such that when the drill bit is rotated about the rotation axis and advanced along the rotation axis into a surface, at least one distal-most tooth maintains contact with the surface and at least one proximal-most tooth does not contact the surface.

The teeth may be formed as monolithic extensions of the tubular portion prior to application of the drilling abrasive. The drill bit may be adapted to drill through concrete. The at least one distal-most tooth may support a thicker deposit of abrasive than the at least one proximal-most tooth. The drill may be configured to drill a straight tubular hole. The tubular portion may be angled slightly about the rotation axis to produce tooth face contact emulating circular oscillation of the drill motor, yet allowing the drill and drill motor to maintain the rotation axis along a constant line with respect to the drilled material. That is, the drill may be progressed without oscillation about the distal centerline of the drilled hole. The teeth of the drill may be varied in length; along the rotation axis of the drill bit, wherein each of the teeth has a face with a curved tangential profile that forms a continuous profile with adjacent teeth as the continuous profile extends around the circumference of the tubular portion. Each tooth may have a distal face that is perpendicular to the rotation axis. Each tooth may have a distal face that is angled or ramped along the periphery with respect to a plane perpendicular to the rotation axis. The drill bit may include two or more cycles of teeth.

The cycles may be identical or may vary.

An example abrasive core drill bit includes: a hollow tubular body having a rotation axis and being configured to be rotated by a drill about the rotation axis; and a ramped tooth disposed along the periphery of a distal end of the tubular body and supporting a drilling abrasive, wherein the tooth has a distal face that is angled or ramped along the periphery of the distal end of the tubular portion with respect to a plane perpendicular to the rotation axis such that the distal extension progresses to a distal-most region of the distal face, such that when the drill bit is rotated about the rotation axis and distally advanced along the rotation axis into a surface, the ramped tooth exerts an axially directed grinding force on the surface that at least one of a) gradually increases and b) gradually decreases, as the tooth passes over a location of the surface.

The distal-most region of the distal face of the ramped tooth may be configured to maintain contact with the surface and the other regions of the distal face may be configured to not contact the surface when the drill bit is rotated about the rotation axis and distally advanced along the rotation axis into the surface.

The drill bit may further include a shank coupled to the hollow tubular body and configured to be received by the drill in order to rotate the hollow tubular body about the rotation axis The tooth may be one of a plurality of like teeth along the periphery of the distal end of the tubular portion.

The tooth may include a tangentially directed step face extending along the rotation axis of the drill bit, the step face being adjacent the distal-most region of the tooth.

An example method of drilling into a material, comprises rotating the drill bit about the rotation axis such that the ramped distal face of the tooth trails the step face of the tooth, and distally progressing the rotating drill bit along the rotation axis and into the material.

Further, an example method of drilling into a material, comprises rotating the drill bit about the rotation axis such that the step face of the tooth trails the ramped distal face of the tooth, and distally progressing the rotating drill bit along the rotation axis and into the material.

A further example method of drilling into a material, comprises: rotating an abrasive drill bit about a rotation axis; and while rotating the drill bit, advancing the drill bit in a forward direction along the rotation axis, wherein throughout the advancing step, at least one distal-most tooth maintains constant contact with the surface of the material, and at least one proximal-most tooth remains at an axial distance from the surface of the material.

Further details and aspects of example embodiments of the present invention are described in more detail below with reference to the appended figures.

DETAILED DESCRIPTION

An experimental modification of an existing diamond bit design as in U.S. Pat. No. 7,204,244 has been conducted. Using a conventional bit, for example, when drilling a 4½ inch diameter hole to an ultimate depth of 17 inches, drilling progress slowed from approximately four inches per half hour to one quarter inch per half hour during the first half of the drilling process. This experiment was conducted with approximately two hundred pounds of pressure and constant water cooling. Drill improvement was achieved by sawing off the conventional bit drill tube at a slight angle at about one inch back from the diamond teeth and rotating the toothed portion with respect to the drill tube by 180 degrees and welding it back on. This arrangement positions fewer teeth in contact with the material face as the drill rotates than would be the case if the teeth lay in a plane perpendicular to the drill center line (see FIG. 2). This drill modification results in the drilling progress being increased to approximately 7½ inches per half hour.

Figure 1:
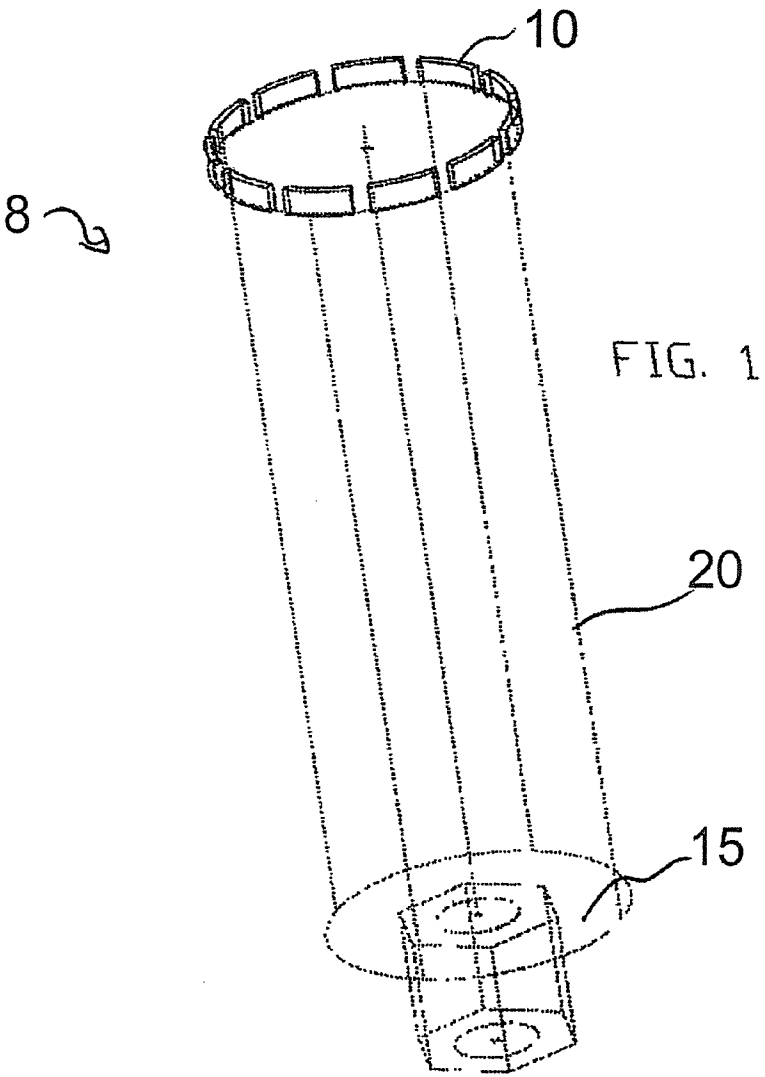
FIG. 1 illustrates a conventional core drill with tooth faces at 90 degrees, i.e., perpendicular, to a center axis of rotation.

FIG. 1 illustrates a conventional drill bit 5 having features similar to the drill bit taught in U.S. Pat. No. 7,204,244. All teeth 10 of the drill bit 8 are equidistant from the rear mounting face 15 of the drill tube 20. While such a conventional drill bit 8 may allow holes to be drilled through hard materials, e.g., concrete, the conventional drill bit 8 may not provide an optimal drilling rate without, moving the rear portion of the bit, with respect to the axis of the hole being drilled, e.g., oscillation.

The drill bits of example embodiments of the present invention described herein may differ from the conventional core bits in that, inter alia, a substantially smaller percentage of the distal circumferential periphery contacts the base or substrate to be drilled. This may be achieved in various different ways in accordance with the example embodiments described below. For example, one or more teeth may extend distally beyond the remainder of the teeth. Having a smaller percentage of the circumferential periphery in contact with the substrate may lead to a smaller contact area.

Further, the varying distal extension of the teeth, or portions thereof, may lead to an axially directed grinding force that varies cyclically as the drill rotates. In this regard, the force is generally increased in regions (e.g., teeth or surfaces thereof) that are distally beyond other regions, and vice-versa. Accordingly, where the distal tooth extension varies along the circumference of the distal end of the drill bit, the grinding force may vary accordingly. For example, the force exerted by the drill at the particular locations of the substrate may gradually increase and/or decrease, depending on the drill bit orientation, as the drill bit is rotated.

The variation in distal extension of the bit leads to a concentration of the force in more distally extending regions along the periphery of the bit, and corresponding reduction in the percentage of the force exerted in less distally extending regions. This concentration of force leads to increased localized force (and pressure) exerted on the substrate at the more distally extending regions along the circumferential periphery of the bit and a corresponding decreased localized force (and pressure) at less distally extending regions. Thus, as the bit is rotated, locations of the substrate along the circumferential periphery of the hole cut by the drill bit will be exposed to a cyclical force (and pressure) exerted by the bit in an alternatingly increasing and decreasing manner.

The cyclical variation (alternatingly increasing and decreasing) in drilling force exerted on the drilled substrate may lead to an impact-like effect, which may be beneficial for drilling substrates such as concrete and the like. Further, the cyclical increasing and decreasing of drilling force seen at locations of the substrate along the circumferential periphery of the hole may also be beneficial with regard to the manner in which the particulate matter of the substrate is crushed during drilling.

The force variations due to the bit configuration are present even where a constant, or substantially constant, axially directed force is exerted via the motor to the bit. That is, the force variations due to the bit configuration are localized in areas of the substrate along the circular cut path, while the overall axial force exerted by the bit to the surface may be equal, or substantially equal, to the axial force exerted from the drill to the bit.

Although the example arrangements are counterintuitive in view of the conventional core drill bit (which seeks to provide a greater contact area such that a greater amount of abrasive is in contact with the drilled surface), it may allow for increased localized drilling pressure at one or more positions along the distal circumferential periphery. Thus, the localized area of increased pressure rotates with the drill bit such that the high-pressure contact area rotates along the circumference of the cut being formed into the drilled substrate. Some example embodiments may provide for less than half of the circumferential periphery (e.g., 10% or less) to be in contact with the substrate during drilling.

Figure 2:
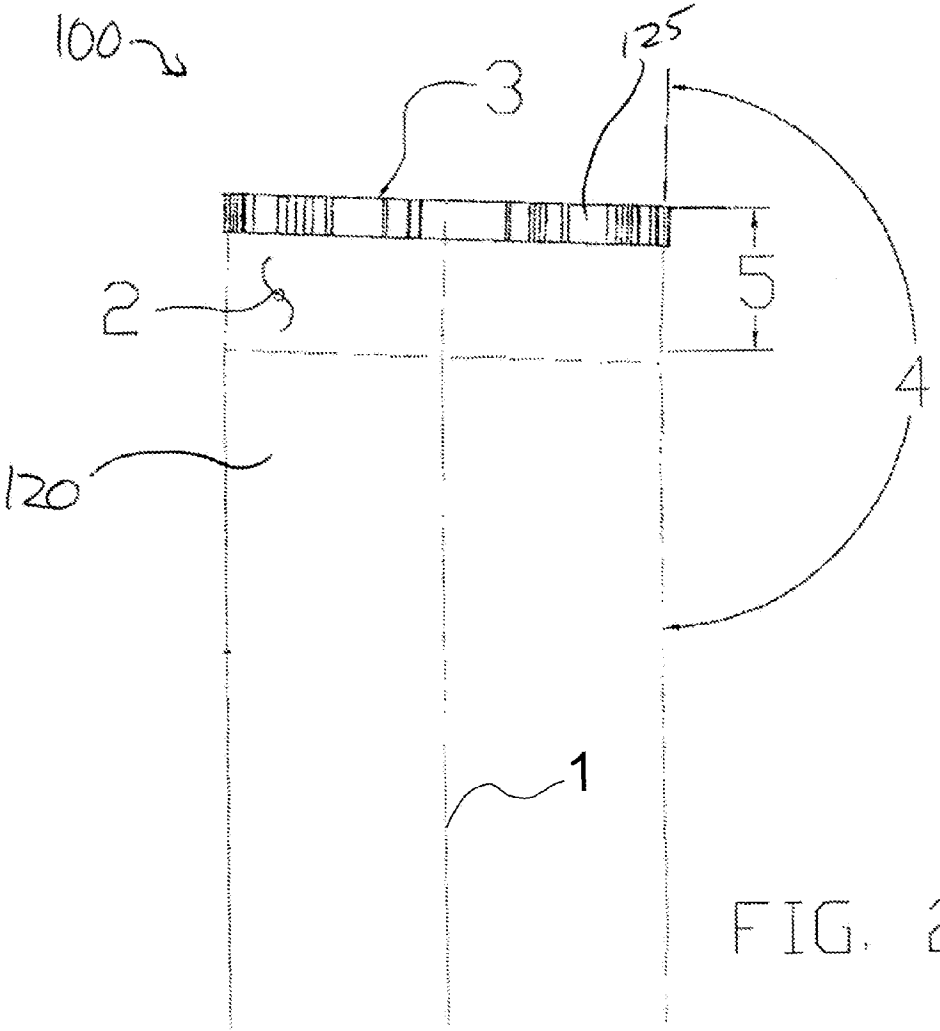
FIG. 2 illustrates a core drill with the drill tube angled near the distal toothed end.

FIG. 2 illustrates a drill bit 100 in accordance with a first example embodiment of the present invention. The drill bit 100 differs from the drill of U.S. Pat. No. 7,204,244 in that the tube 120 has been angled by an angle 4 at a distance 5 back from the tooth face 3. The center line of the drill tube 1 and the drill motor is slightly angled from the portion 2 of the drill tube 120 to which the teeth 125 are attached. This results in some teeth 125 being further from the rear of the drill tube than the others. Thus, as the drill bit rotates about the center line of the drill motor, the angled axis at the end of the drill tube 120 nutates. The distance 5 may be selected such that the center of the tooth face 3 (i.e., the location where the angled axis intersects the plane of the tooth face 3) remains relatively close to the rotational axis of the drill. The unbalanced quality of this arrangement during rotation about the centerline of the shank may cause additional vibration to be imparted into the drill bit, which may further enhance the drilling speed.

Figure 3A:
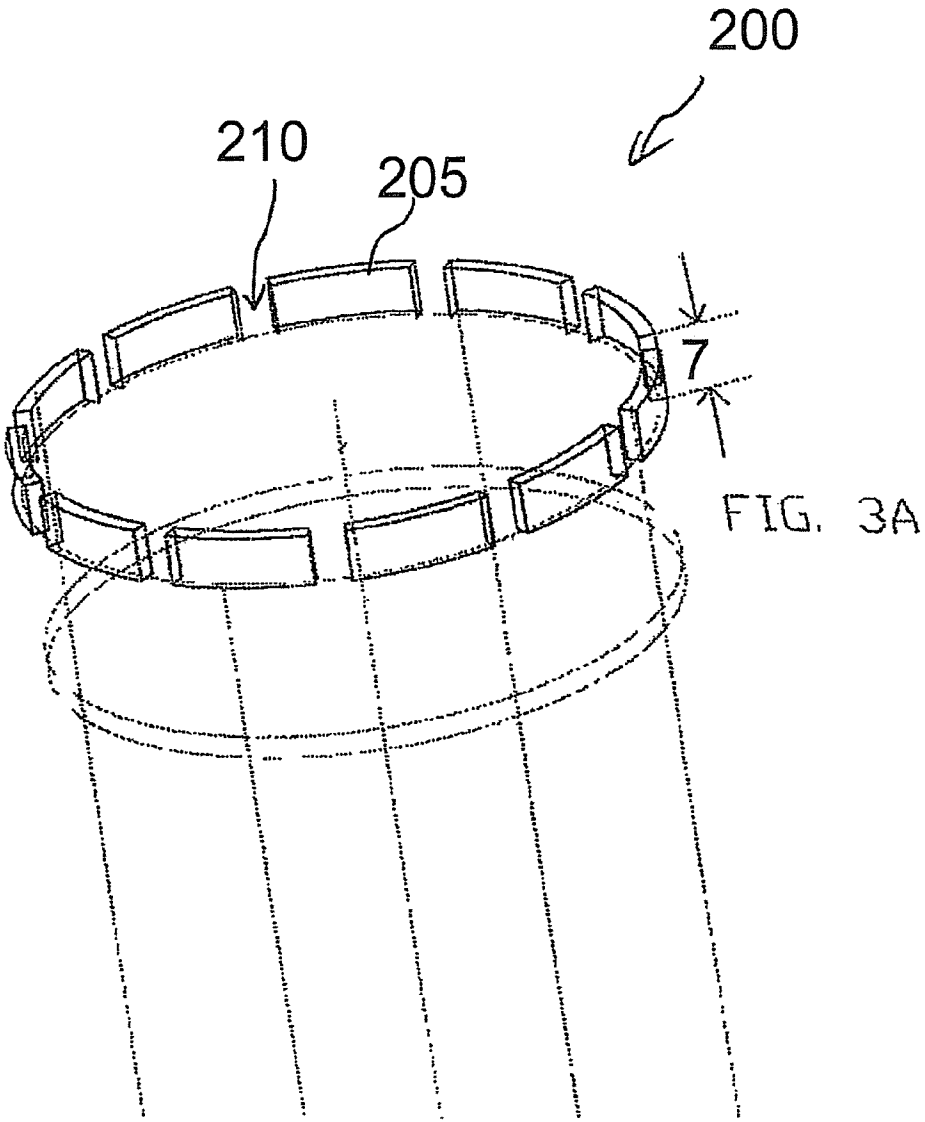
FIG. 3A illustrates a drill having a straight drill tube having teeth that are closer and further from a perpendicular plane (i.e., the work face) constructed from the center line of rotation of the drill bit.
Figure 3B:
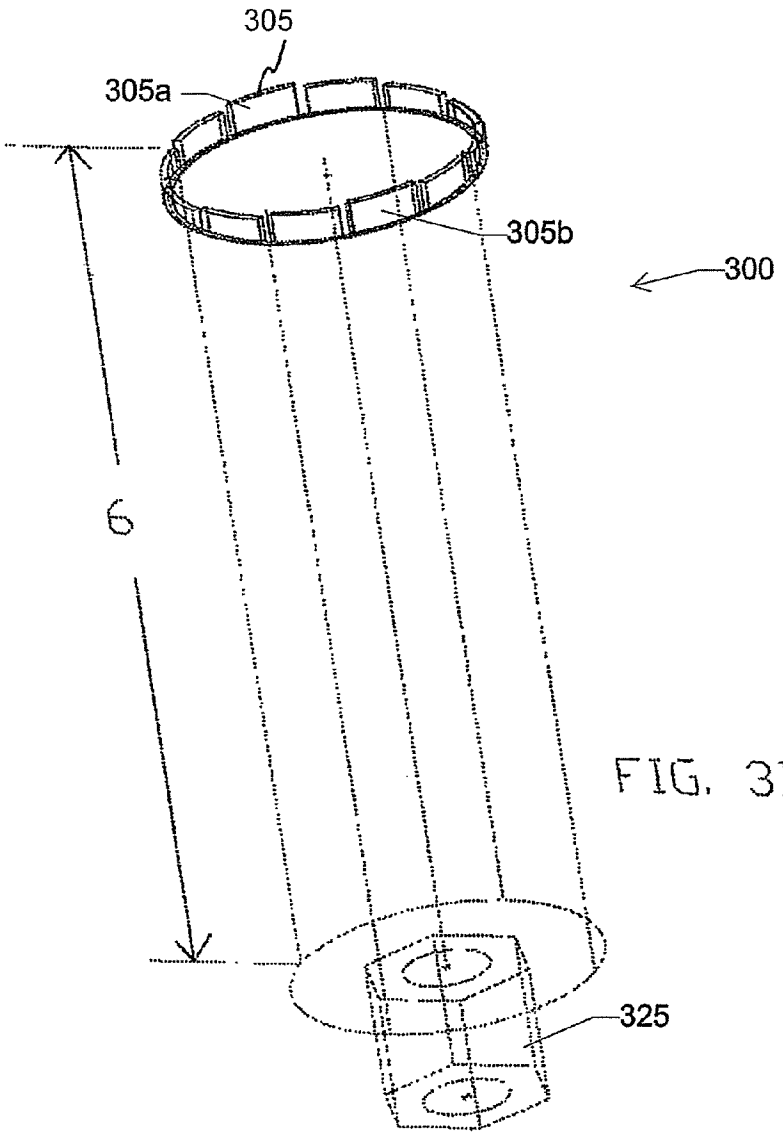
FIG. 3B illustrates a drill having features similar to the drill illustrated in FIG. 3A but with more than one cycle of longer and shorter teeth.

FIGS. 3A and 3B illustrate drill bits 200 and 300 in accordance with second and third example embodiments, respectively, of the present invention. The drill bits differ from the drill bit of the first example embodiment in that the drill tube does not have an angled axis.

Although the drill bit of the second example embodiment does not have a tube with a portion having an angled axis, it should be appreciated that the drill bit of the second embodiment may include an angled axis as described in connection with the first embodiment, while also having teeth of different lengths.

The distal portion of the drill bit 200 is formed as a hollow tubular body, with the teeth 205 being integral or monolithic extensions of the hollow tubular body. In this regard, the teeth are formed by notches 210 cut into the tubular body to form each tooth between each adjacent pair of notches. The differing lengths of the teeth 205 may be provided by any appropriate process, e.g., cutting or grinding the distal portions of one or more of the teeth. The teeth are then coated with an abrasive coating, e.g., a diamond abrasive coating, an aluminum oxide coating, or any other appropriate abrasive coating.

In FIG. 3A the teeth 205 are closer and further from the rear of the drill tube without a portion of the tube being angled. In the embodiment illustrated in FIG. 3B, the same condition persists as in 3A except that two or more teeth 305 are simultaneously at the same distance from the rear of the drill tube 300, illustrated as distance 6. In this example, two or more longest teeth could contact the work face simultaneously and in a direction perpendicular to the work face. In the example illustrated in FIG. 3B, the drill has exactly two teeth 305*a* and 305*b* disposed at opposite locations, i.e., at one-half of a full revolution, along the circumference of the bit. It should be understood, however, that any appropriate number of distalmost teeth may be provided and disposed at any appropriate locations along the circumference of the drill bit.

These various systems provide small differences in the distance 6 (measured as progressing around the circumference) allowing that fewer teeth are contacting the drilled face at the same time, which may emulate the oscillation of the drill motor at the beginning of the hole. These tooth position arrangements may emulate the drill motor orbital oscillation yet allow the drill tube to remain parallel with the sides of the hole. To accommodate the increased abrasion of the tooth material on teeth with greater dimension 6, being eroded more so than teeth with lesser dimension 6, the deposition of abrasive material dimension 7 could be greater on teeth with a greater dimension 6. Drill life could thus be extended, as the teeth with greater dimension 6 would contact the workface sooner and longer until worn.

Although the teeth in the illustrated embodiments of FIGS. 3A and 3B have distal faces that are perpendicular to the axis of the distal end of the drill bit, it should be appreciated that the distal faces may be of any appropriate configuration. For example, the differing lengths of the teeth may be achieved by making one or more diagonal or angled cuts into the end portion of the drill bit, either before or after the notches are formed in the tubular body. In this scenario, the cut teeth would be angled with respect to the axis of the drill bit according to the angle of the cut. Where the end portion is cut in this manner, each cut may be straight, curved, or a combination of straight portions and curved portions.

Figure 4A:
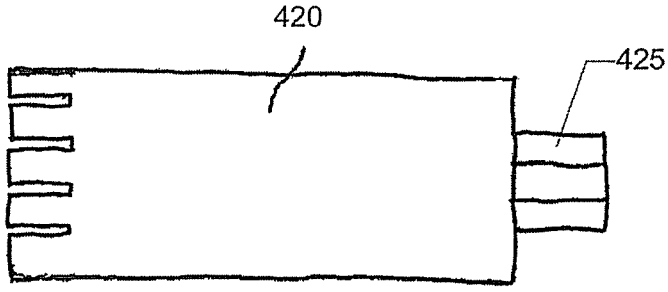
FIGS. 4A to 4D illustrate methods of making drills according to example embodiments of the present invention.
Figure 4B:
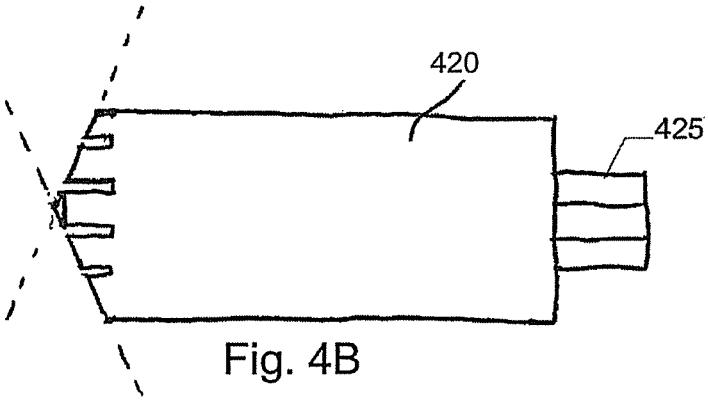
Figure 4C:
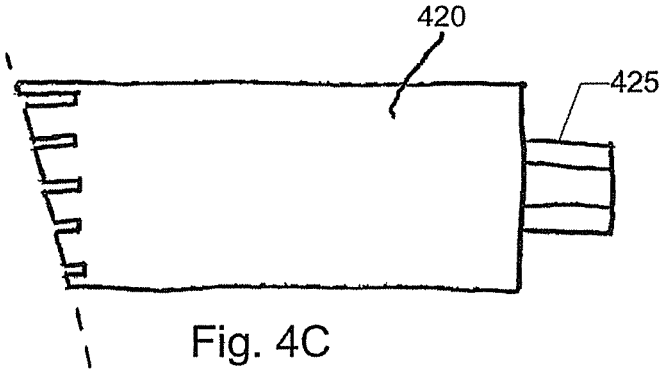
Figure 4D:
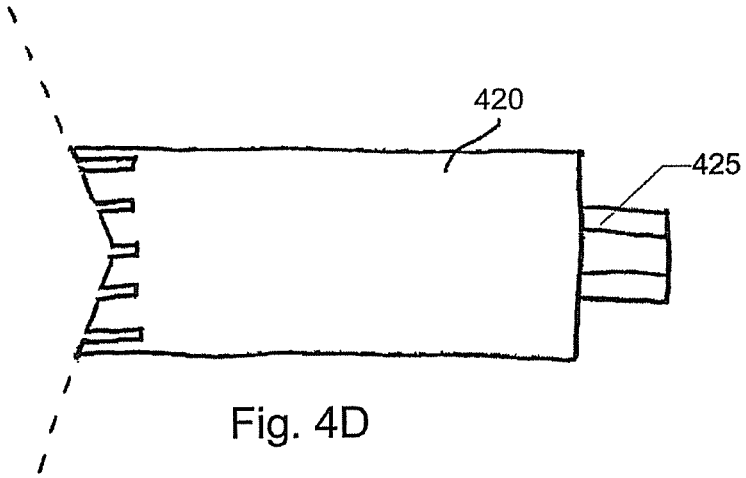
Figure 5A:
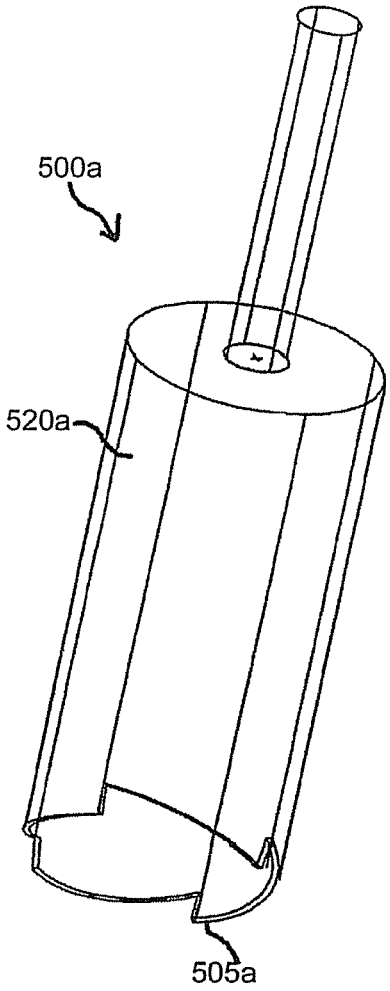
FIGS. 5A to 6B illustrates drills with teeth that are ramped as they progress around the circumferential periphery of the drill tube.
Figure 5B:
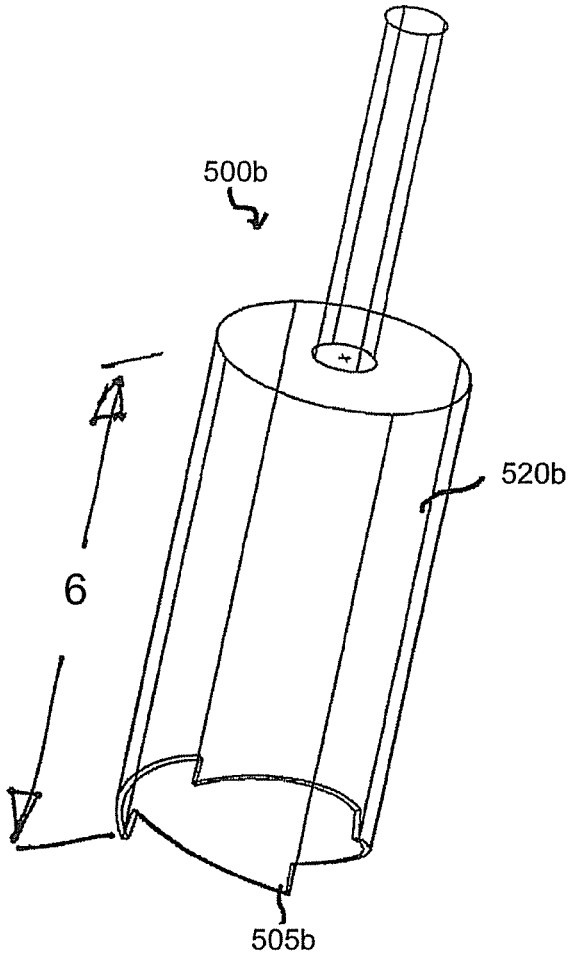
Figure 6A:
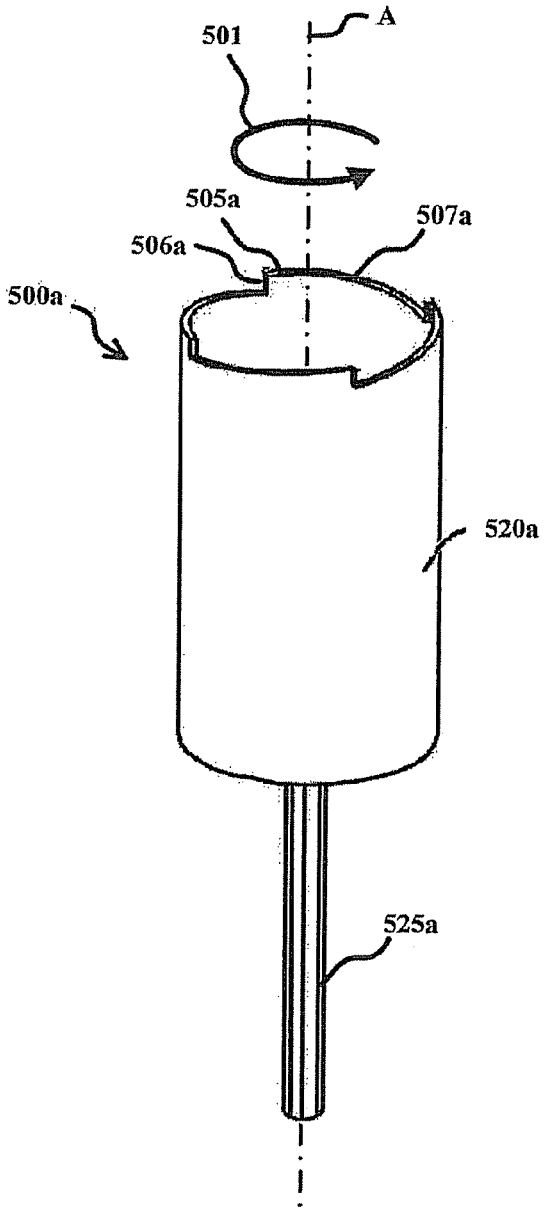
Figure 6B:
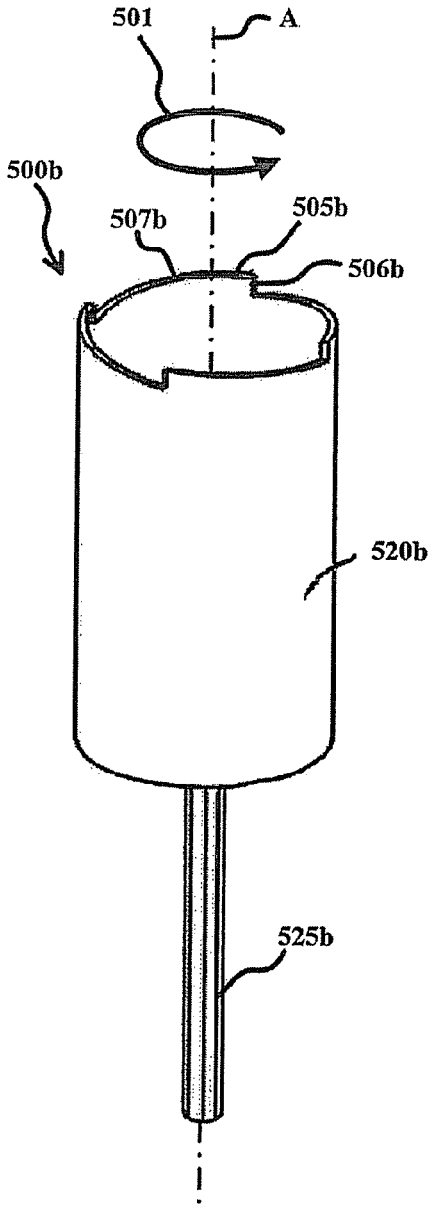

FIGS. 4A to 4D illustrate example non-limiting methods of forming drill bits according to example embodiments of the present invention. FIG. 4A illustrates a base drill tube 420 that may be formed by cutting notches into a tubular drill bit body as described above. FIGS. 4B to 4D illustrate various diagonal cuts that may be made to the base drill tube 420 to form differing tooth lengths. It is noted that, for the sake of illustration, the cut angles, shown in broken lines, have been exaggerated. The abrasive coating, e.g., diamond coating, is preferably, but optionally, applied after the cuts have been formed.

FIGS. 5A to 6B show drill bits 500*a*, 500*b* in accordance with other example embodiments where the teeth 505*a*, 505*b* are ramped as they progress around the periphery of the drill tube 520*a*, 520*b*, such that the several teeth contracting the workface will bring increasing or decreasing force upon the work surface as the incremental rotation of the drill progresses. The number of teeth of each bit 500*a*, 500*b*, which may support a drilling abrasive, e.g., by being coated or impregnated therewith, may be more or less than those shown in FIGS. 5A to 6B. For example, a single tooth may be provided, which may extend along the entire circumferential periphery or less than the entire circumferential periphery. Likewise any of the other bits in accordance with the various example embodiments described herein may be provided with more or less teeth than illustrated.

The drill bit 500*a* differs from the drill bit 500*b* in that the teeth in drill bit 500*b* are ramped in a direction opposite to the ramping direction of the teeth of drill bit 500*a*. Thus, when the drill bit 500*a* is rotated clockwise (when viewed along the rotation axis A in the distal direction; as illustrated by rotation arrows 501 in FIGS. 6A and 6B) during drilling, the step or axially extending wall 506*a* of each tooth 505*a* would lead the tapered or ramped portion 507*a* of the respective tooth 505*a* of the drill bit 500*a*, whereas the step or axially extending wall 506*b* of each tooth 505*b* would trail the tapered or ramped portion 507*b* of the respective tooth 505*b* of the drill bit 500*b*. Accordingly, each tooth 505*a* the drill bit 500*a*, when rotated clockwise, would provide a high level of localized initial force and pressure to the substrate at locations along the periphery of the cut, followed by a gradually decreasing pressure, as the tapered or ramped portion 507*b* of the respective tooth passes the location. The drill bit 500*b*, when rotated clockwise, would provide an initially low level of force and pressure to the substrate at locations along the periphery of the cut, where the force and pressure gradually increase as the bit 500*b* is further rotated, until the wall 506*a* passes the location, at which point the exerted force and pressure at the location abruptly drop. As indicated above, these cyclical force variations (alternatingly increasing and decreasing) in drilling force exerted on the drilled substrate may lead to an impact-like effect and other beneficial drilling qualities.

Although the drilling rotation is shown as clockwise, it should be understood that the drill may be configured to rotate the bit in the opposite direction during drilling.

The distal faces teeth 505*a*, 505*b* of the drill bits 500*a*, 500*b* each have distal-most regions that are at least approximately at the same distal location. That is, the distal portion of each tooth of the respective bit 500*a*, 500*b* has a distal-most portion or surface that maintains contact with a drilled surface during drilling. It should be understood, however, that the bits 500*a*, 500*b* may be skewed and/or teeth of varying distal-most extension may be provided such that some of the teeth do not contact the drilled surface during a linear drilling process.

Further, the ramping of the teeth 505*a*, 505*b* may be linear or non-linear. For example, the ramping may form a line or a curve if the tube body 520*a*, 520*b* were unrolled and flattened.

For anchoring the drill bits of the various example embodiments described herein to the drill motor, any appropriate anchoring mechanism may be provided. As in the figures, the example bits each have a shank 325, 425, 525*a*, 525*b*, which may be inserted into and gripped by a chuck of the drill. It should be understood, however, that other attachment mechanisms may be provided, e.g., sleeve devices. Further, the example drill bits may be provided with an anchoring mechanism that is adapted to couple to various different types of anchoring or mating systems of different drills. As used herein, "shank" should be understood to encompass not only shafts or protrusions such as shanks 325, 425, 525*a*, and 525*b*, but also any other attachment mechanism configured to couple the drill bit to a drill in order to rotate the drill bit.

It should be understood that the teeth of any of the aforementioned embodiments may be straight or may be "kerfed" such that, e.g., progressing circumferentially, a cycle may be provided where one tooth is angled radially inwardly, the next tooth angled radially outwardly, the next tooth being centered or straight, and so on.

Although the bases of the teeth of the example embodiments described above are formed as integral or monolithic extensions of the tubular bodies of the exemplary drill bits, it should be appreciated that some or all of the teeth may be formed as separate pieces and subsequently attached to the tubular body, either before or after application of the abrasive coating.

Further, although the present invention has been described with reference to particular examples and exemplary embodiments, it should be understood that the foregoing description is in no manner limiting. Moreover, the features described herein may be used in any combination.

What is claimed is:

1. An abrasive core drill bit comprising:

a hollow tubular body having a rotation axis and being configured to be rotated by a drill at a relatively constant rate about the rotation axis; and a plurality of teeth disposed around the periphery of a distal end of the tubular body and extending distally from the tubular body, each of the plurality of teeth supporting a drilling abrasive, wherein the abrasive core drill bit is designed to cut material primarily through abrasive action wherein the plurality of teeth rotate at the same rate as the drill, wherein the distal extension of the teeth relative to each other varies cyclically along the periphery of the distal end of the tubular body such that when the drill bit is rotated about the rotation axis and advanced along the rotation axis into a surface of a drilled material, at least one distal-most tooth maintains contact with the surface and at least one least distally extending tooth does not contact the surface.

2. The drill bit according to claim 1, further comprising a shank coupled to the hollow tubular body and configured to be received by the drill in order to rotate the hollow tubular body about the rotation axis.

3. The drill bit according to claim 1, wherein the teeth are formed as monolithic extensions of the tubular body prior to application of the drilling abrasive.

4. The drill bit according to claim 1, wherein the drill bit is adapted to drill through concrete.

5. The drill bit according to claim 1, wherein the at least one distal-most tooth supports a thicker deposit of abrasive than the at least one proximal-most tooth.

6. The drill bit according to claim 1, wherein the drill is configured to drill a straight tubular hole.

7. The drill bit according to claim 1, wherein the tubular portion is angled slightly about the rotation axis to produce tooth face contact emulating circular oscillation of a drill motor, yet allowing the drill to maintain the rotation axis along a constant line with respect to the drilled material.

8. The drill bit according to claim 1, wherein the teeth of the drill are varied in length; along the rotation axis of the drill bit, wherein each of the teeth has a face with a curved profile that forms a continuous profile with adjacent teeth as the continuous profile extends around the circumference of the tubular portion.

9. The drill bit according to claim 1, wherein each tooth has a distal face that is perpendicular to the rotation axis.

10. The drill bit according to claim 1, wherein each tooth has a distal face that is angled or ramped along the periphery with respect to a plane perpendicular to the rotation axis.

11. The drill bit according to claim 1, wherein the drill bit includes two or more cycles of teeth.

12. The drill bit according to claim 11, wherein the cycles are identical.

13. An abrasive core drill bit comprising:

a hollow tubular body having a rotation axis and being configured to be rotated by a drill at a relatively constant rate about the rotation axis; and a ramped tooth disposed along the periphery of a distal end of the tubular body and supporting a drilling abrasive, wherein the abrasive core drill bit is designed to cut material primarily through abrasive action, wherein the ramped tooth is rotated at the same rate as the drill, wherein the tooth has a distal face that is angled or ramped along the periphery of the distal end of the tubular portion with respect to a plane perpendicular to the rotation axis such that the distal extension progresses to a distal-most region of the distal face, such that when the drill bit is rotated about the rotation axis and distally advanced along the rotation axis into a surface, the ramped tooth exerts an axially directed grinding force on the surface that at least one of a) gradually increases and b) gradually decreases, as the tooth passes over a location of the surface.

14. the drill bit according to claim 13, wherein the distal-most region of the distal face of the ramped tooth is configured to maintain contact with the surface and the other regions of the distal face are configured to not contact the surface when the drill bit is rotated about the rotation axis and distally advanced along the rotation axis into the surface.

15. The drill bit according to claim 13, further comprising a shank coupled to the hollow tubular body and configured to be received by the drill in order to rotate the hollow tubular body about the rotation axis.

16. The abrasive core drill bit according to claim 13, wherein the tooth is one of a plurality of like teeth along the periphery of the distal end of the tubular portion.

17. The abrasive core drill bit according to claim 13, wherein the tooth includes a curved step face extending along the rotation axis of the drill bit, the step face being adjacent the distal-most region of the tooth.

18. A method of drilling into a material, comprising:

rotating the drill bit of claim 17 about the rotation axis such that the ramped distal face of the tooth trails the step face of the tooth; and distally progressing the rotating drill bit along the rotation axis and into the material.

19. A method of drilling into a material, comprising:

rotating the drill bit of claim 17 about the rotation axis such that the step face of the tooth trails the ramped distal face of the tooth; and distally progressing the rotating drill bit along the rotation axis and into the material.

20. A method of drilling into a material, comprising:

rotating an abrasive drill bit about a rotation axis, wherein the drill bit is rotated at a relatively constant rate; and while rotating the drill bit, advancing the drill bit in a forward direction along the rotation axis by applying a relatively constant force in the direction along the rotation axis, wherein throughout the advancing step, at least one distal-most tooth maintains constant contact with the surface of the material, and at least one proximal-most tooth remains at an axial distance from the surface of the material.

* * * * *